US007470292B2

(12) United States Patent
Gupta et al.

(10) Patent No.: US 7,470,292 B2
(45) Date of Patent: Dec. 30, 2008

(54) ANTIOXIDANT COMPOSITION FOR MOTOR GASOLINE

(75) Inventors: Anurag Ateet Gupta, Faridabad (IN); Suresh Kumar Puri, Faridabad (IN); Subhash Chand, Faridabad (IN); Vinod Kumar Sharma, Faridabad (IN); Rajagopal Manoharan, Faridabad (IN); Rameshwar Prashad, Faridabad (IN); Niranjan Raghunath Raje, New Delhi (IN); Akhilesh Kumar Bhatnagar, Faridabad (IN)

(73) Assignee: Indian Oil Corporation Limited, Mumbai (IN)

( * ) Notice: Subject to any disclaimer, the term of this patent is extended or adjusted under 35 U.S.C. 154(b) by 689 days.

(21) Appl. No.: 10/922,659

(22) Filed: Aug. 20, 2004

(65) Prior Publication Data

US 2005/0091914 A1 May 5, 2005

(30) Foreign Application Priority Data

Oct. 31, 2003 (IN) ..... 1150/MUM/2003

(51) Int. Cl.
*C10L 1/22* (2006.01)

(52) U.S. Cl. ..... 44/415; 44/412; 44/428

(58) Field of Classification Search ..... 44/412, 44/415, 428

See application file for complete search history.

(56) References Cited

U.S. PATENT DOCUMENTS

| | | | | | |
|---|---|---|---|---|---|
| 4,231,759 | A * | 11/1980 | Udelhofen et al. | ..... | 44/415 |
| 5,169,410 | A * | 12/1992 | Wright | ..... | 44/415 |
| 5,679,116 | A * | 10/1997 | Cunningham et al. | ..... | 44/359 |
| 2002/0066225 | A1 * | 6/2002 | Puri et al. | ..... | 44/307 |

* cited by examiner

*Primary Examiner*—Glenn Caldarola
*Assistant Examiner*—Jim Goloboy
(74) *Attorney, Agent, or Firm*—Allen, Dyer, Doppelt, Milbrath & Gilchrist, P.A.

(57) ABSTRACT

An antioxidant composition effective for stabilizing gasoline and gasoline components contains from approximately 50-95% by weight of at least one Mannich base and from approximately 5-50% by weight of at least one amine. The Mannich base is derived from p-substituted phenols or from cashew nut shell liquid.

3 Claims, No Drawings

ANTIOXIDANT COMPOSITION FOR MOTOR GASOLINE

CROSS-REFERENCE TO RELATED APPLICATIONS

This application claims the benefit of Indian Foreign Application No. 1150/MUM/2003 filed Oct. 31, 2003.

FIELD OF THE INVENTION

This invention relates to the development of new antioxidant composition for use in motor gasoline fuel.

BACKGROUND OF THE INVENTION

Motor gasoline fuel when stored for a prolonged period of time eventually deteriorates due to oxidation and polymerization. Cracked streams, increasingly being used in gasoline fuel, are worsening the problem. The deterioration of fuel is evidenced by the formation of gums and darkening of color. The gum formation in the fuel system further leads to filter blockage resulting in reduction in fuel flow to the engine.

In general, the process of fuel degradation is very complex in view of the variety of hydrocarbons involved in it. It involves free radical reactions, which are characterized by three distinct stages, viz. initiation, propagation and termination. These reactions are very complex and have implications on the quality of fuel.

Unsaturated compounds such as olefins and dienes contribute to instability by auto-oxidation and/or polymerization reactions in the presence of oxygen. Higher levels of unsaturated compounds in the fuels are due to increased severity of secondary refining operations in Fluid Catalytic Cracking (FCC) as well as renewed blending of streams from thermal processes such as Viscosity Breaker (VB) and Coker. These products are used for blending gasoline fuel in order to meet the growing demand.

Furthermore, only olefins and dienes are not responsible for instability of fuels. In deeply hydrotreated or reformed fuels, most of the natural antioxidants get removed during the process leading to poor stability of the product. If even trace amount of copper is present in the fuel, it shall accelerate the rapid formation of peroxides. The peroxides thus formed shall attack the copper parts of fuel system with the result copper dissolution takes place leading to even more peroxide formation resulting into accelerated oxidation of fuel. Frequent sources of copper contamination are copper-containing alloys in refinery equipment, product distribution systems, chemicals used in the refining and the fuel system of vehicles. The catalytic effect of copper is so strong that even the most effective antioxidants/stabilizers cannot provide adequate stability in the presence of copper, thus resulting in deterioration of the product.

The options available to refiners for improving gasoline fuel quality are limited. The following four main approaches are usually practiced at refineries the world over for improving gasoline fuel quality: selective blending of refinery streams; use of chemical additives; adopting an appropriate processing route, which may include, aromatic extraction, hydrogenation and hydro-cracking; and use of chemical additives in combination with processing.

Aromatic extraction and hydro-cracking options result in significant changes in product yield, whereas hydrogenation has only marginal impact on product balances. The problem of gasoline stability can effectively be solved by the incorporation of carefully selected chemical additives in proper concentrations. These chemical additives primarily retard the natural degradation of gasoline fuel during long-term storage.

Alkyl or aryl substituted hindered phenols are commonly used for stabilization of gasoline fuel. The stearic hindrance in the hindered phenols is provided by bulky substituents in ortho position to the hydroxyl group in the ring of the phenolic antioxidant. These bulky substituents influence the specificity of these phenols by blocking phenoxyl radicals from abstracting hydrogen atoms from organic substrates. 2,6-Di-t-butylphenol (DTBP) is a most widely used functional group in commercial hindered phenolic antioxidants. DTBP is effective and easily made at moderate cost by ortho alkylation of phenol by olefins using ortho selective catalyst. Preparation of nitroalkane based hindered phenols and their antioxidant properties are reported in British Patent No. 1,561,311.

European Patent No. EP 106,799 assigned to Sandoz GmbH describes a mixture of sterically hindered phenols having recrystalisation temperature <10 deg. C. These types of compounds are reported to be useful antioxidants for liquid fuels, especially for gasoline. Canadian Patent CA 1,216,308 assigned to Ethyl Corporation reported p-alkylenes hindered phenols as useful antioxidants for gasoline, lubrication oils, plastics, rubbers etc. U.S. Pat. No. 4,981,495 reported that the oxidation stability of gasoline mixture is improved by adding to the gasoline 1-10,000 ppm of an alkyl-1,2-dihydroquinoline compound, dimer, trimer or polymers. Optionally, a hindered phenol may be jointly used with the quinoline compounds. Halon and Vincent have reported in European Patent EP 427,456 that a liquid mixture of alkyl phenols composed of 2-t-butylphenol and 2,6-di-t-butylpheno are suitable for use as stabilizers for middle distillate fuels, fuel oils etc. European Patent EP 410,577 discusses polymeric reaction products of an ortho substituted phenol as an antioxidant for liquid hydrocarbons such as kerosene and gasoline. German Patent No. 2,917,927 describes that alkylated dihydroxbiphenyls are useful as antioxidants and can help in improving the induction period. Japanese Patent No. 81,92,235 reported trialkyl-tris(3,5-dialkyl-4 hydroxybenzyl)benzene as a stabilizer for rubbers, gasoline etc. However, the disadvantage associated with using a phenolic antioxidant alone includes high treat levels, inability to effectively control peroxides formed during the oxidation process and inability to check retard colour degradation of fuels.

Aromatic amines have been well known as antioxidants but the mechanism of their action has not been well established, as compared to phenolic antioxidants. Basically, some of the aromatic amines are quite complex compositions and a number of oxidation products are obtained from the reaction of aromatic amines and fuel degradation products. Aromatic amines commonly being used are phenylenediamines and diarylamines. However, several synergistic combinations are also documented in the literature.

U.S. Pat. No. 4,279,621 reported that heavy polyamines distillation residues can be used as antioxidants for gasolines at a treat level of 0.05 wt %. Japanese Patent Jpn Kokai Tokyo Koho JP 58,76,492 assigned to Sumitomo Chemical Co. Ltd. reported a mixture of a 2-tert-butyl alkyl phenol, bis (nonyl phenol) amine and ditridecylthiodipropionate as an antioxidant for gasoline, kerosene, light oils and heavy oils. U.S. Pat. No. 4,456,541 assigned to Ethyl Corporation reports that the addition of 3,5-diethyltolune-2,4-diamine or 3,5-diethyltolune-2,6-diamine or their mixture in appropriate concentration provides antioxidant properties to polymers, gasoline, lube oils and other organic compounds.

U.S. Pat. No. 4,871,374 assigned to Petrolite Corp. reported that a fuel oil can be stabilized with an imine-enamine condensate. This additive is claimed to be effective in improving the colour stability and sedimentation of distillate oils. U.S. Pat. No. 4,647,290 reports that the colour deterioration of a distillate fuel oil is inhibited by addition of a mixture of N-(2-aminoethyl) piperazine and $HONEt_2$. A straight-run gasoline fuel containing 200 ppm of N-(2-aminoethyl) piperazine and 300 ppm of $HONEt_2$ was placed in an oven at 140 deg. F. for 14 days, cooled, and filtered; the ASTM colour of the filtrate was 2.5 (ASTM D-1500), compared with 5.0 for the gasoline fuel containing only N-(2-aminoethyl) piperazine. U.S. Pat. No. 5,197,996 reports that a boron based additive helps in the colour stabilization of distillate fuel oil. U.S. Pat. No. 5,035,719 describes that storage stability of middle distillate fuels is improved by adding an acrylate polymer containing moieties derived from 4-vinylpyridine or the enamine ester of morpholine etc. and propionaldehyde as additive. U.S. Pat. No. 4,978,366 reports that distillate fuel especially which has a high acid number initially or which develops a high acid number as a result of fuel degradation, is stabilized with a diaminomethane. Henry and West have reported in U.S. Pat. No. 5,011,504 that block copolymers of acrylic and acrylic amines can be used as additives for fuel oils to diminish sediment and colour formulation. A suitable additive as reported by them is 2-ethylexylmethacrylate-dimethylaminoethyl methacrylate copolymer. U.S. Pat. No. 5,057,123 describes that diesel fuel at high temperature can be stabilized with an amine-containing copolymer selected from aminopropyl morpholine ethylene-propylene-hexadiene copolymer as N-phenylenediamine ethylene-propylene-hexadiene copolymer and N-aminopropyl-N-phenylenediamine ethylene-propylene-hexadiene copolymer. Though amine based antioxidants are excellent oxidation inhibitors for gasoline and other middle distillate fuels, they are costly and their use in fuels adversely affects the economics of oil refineries.

Commercial Cashew Nut Shell Liquid (also known as CNSL) is obtained by hydrogenation of naturally occurring, biodegradable, vegetable based cashew nut shell liquid. CNSL is a reddish brown viscous liquid which occurs in the soft honeycomb structure of the shell of cashew nut. CNSL, extracted from shells with low boiling petroleum either, contains about 90% anacardic acid and about 10% cardol. CNSL, on distillation, gives pale yellow phenolic derivatives which are a mixture of biodegradable unsaturated m-alkylphenols, including cardanol. Catalytic hydrogenation of these phenols produces a white waxy material, predominantly rich in tetrahydroanacardol, which is also known as hydrogenated CNSL. CNSL and its derivatives have been known for producing high temperature phenolic resins and friction elements, as exemplified in U.S. Pat. Nos. 4,395,498 and 5,218,038. Friction lining production from CNSL is also reported in U.S. Pat. No. 5,433,774. Likewise, it is also known to form different types of friction materials, mainly for use in brake lining system of automobiles and coating resins from CNSL.

Mannich condensation products are rarely reported as antioxidants for gasoline. However, they are known to act as dispersants and detergents in various types of hydrocarbon stocks. Their use in lighter hydrocarbon stocks, such as gasolines, has been disclosed in U.S. Pat. Nos. 3,269,810 and 3,649,229. 3,235,484 (Now U.S. Pat. No. Re. 26,330) describes the addition of certain disclosed compositions to refinery hydrocarbon fuel stocks for the purpose of inhibiting the accumulation of carbonaceous deposits in refinery cracking units.

Several distinct disadvantages are associated with using phenolic antioxidants alone. Such disadvantages include high treat levels, inability to effectively control peroxides formed during the oxidation process and inability to stop colour degradation of fuels.

The disadvantage associated with using amine based antioxidants alone is the considerable cost of such compounds, which affects refinery economics, and their tendency to impart colour to gasoline, as some of the amine based antioxidants are quite dark in colour.

The disadvantage associated with using Mannich bases is their poor antioxidant efficacy for gasoline fuel, when used singularly.

Therefore, an object of this invention is to propose a new gasoline antioxidant composition which obviates the above referred disadvantages.

Another object of this invention is to propose a new gasoline antioxidant composition which can effectively control the gum formation during storage and use.

A further object of this invention is to propose a new gasoline antioxidant composition which can effectively control the colour degradation of gasoline.

A still further object of this invention is to propose a new gasoline antioxidant composition with improved antioxidant characteristics.

Another object of this invention is to propose a new gasoline antioxidant composition which when used in gasoline can reduce copper corrosion and pitting tendency up to the desired level.

Yet further object of this invention is to propose a new gasoline antioxidant composition which when used in fuels can help in controlling water emulsification up to the desired extent.

Another object of the invention is to propose a new gasoline antioxidant composition which does not require use of costly metal deactivator in wide variety of gasoline fuel

SUMMARY OF THE INVENTION

It has now been established through this invention that when Mannich base is incorporated in combination with an amine based antioxidant into the gasoline fuel containing cracked components obtained from various secondary processing units (viz. FCC, VB and Coker, etc.), the oxidation of fuel, sediment formation, corrosion inhibition and water uptake tendencies are improved appreciably in comparison to when any of the aforesaid components is added alone to the fuel.

For example, if amine based antioxidant was used alone then potential gum level was reduced from base value of 132 $g/m^3$-258 $g/m^3$ to around 32 $g/m^3$-38 $g/m^3$ in gasoline fuel at 20 mg/lit to 50 mg/lit as per ASTM D-873/IP: 183 (Modified). While at the same dosages level and at higher levels of Mannich base alone, the potential gum level could not be brought down to the desired level of less than 50 $g/m^3$. However, when using a combination of Mannich base and an amine-based antioxidant, the potential gum level in the gasoline fuel was reduced to approximately 28 $g/m^3$ as compared to 258 $g/m^3$ potential gum value of the base gasoline fuel.

A successful attempt has been made to develop an antioxidant formulation using synergistic combination of amine based antioxidant and Mannich bases derived from commercially available p-substituted phenols and from Cashew Nut Shell Liquid (CSNL).

The amine based antioxidant of the present invention belong to N,N'-Alkyl-butyl-paraphenylenediamine chemistry.

The alkyl phenols used in the process of preparation of Mannich bases are para-nonyl phenol or para-dodecyl phenol or hydrogenated and distilled CNSL. CNSL on distillation, gives pale yellow phenolic derivatives, which are a mixture of biodegradable unsaturated m-alkylphenols, including cardanol. Catalytic hydrogenation of these phenols gives a white waxy material, predominantly rich in tetrahydroanacardol, which is also known as hydrogenated CNSL. Mannich condensation products were prepared by the reaction of para-nonyl phenol or para-dodecyl phenol or the hydrogenated CNSL (hydrogenation of cashew nut shell liquid was carried out in an autoclave using a conventional method of catalytic hydrogenation), an amine having at least one reactive hydrogen atom, and an aldehyde in the molar ratio of 1:0.1 to 10:0.1 to 10 at a temperature ranging from 70° C.-175° C. for 6 to 12 hours in presence of a protic organic solvent.

The Mannich base present in the antioxidant composition varies from 50.0 to 95% by weight, whereas the amine based component is in the range of 50% to 5% by weight. The overall nitrogen content of the synergistic composition of the present invention may vary from 3.5 wt % to 8.5 wt %.

The composition of the present invention has a synergistic effect. Further object and advantages of this invention will be more apparent from the ensuing examples. It is being understood that such examples are not intended to limit the scope of the present invention.

DETAILED DESCRIPTION OF THE PREFERRED EMBODIMENTS

Evaluation Methodology—A correlation programme was conducted to compare various test methods used for assessing performance of gasoline antioxidants. In view that the Potential gum test was found to be quite stringent for assessing the antioxidant performance of a gasoline additive, the Potential Gum Test as per ASTM D-873/IP: 138 (Modified) was selected as the test for evaluating the various individual components and formulated compositions used in this invention. Selected short listed, final candidate compositions were additionally evaluated for existent gum as per ASTM D-381/IP: 131, Induction Period test as per ASTM D-525/IP: 40 and an ambient aging test for three months. The details of various tests used for assessing the antioxidant characteristics in the present invention are set forth:

1. Potential Gum test. A measured quantity of fuel (50 ml) is oxidized under prescribed condition in a container for 4 hrs. at 100 deg. C. after pressurizing it with 100 psi oxygen pressure. The aged product is subjected to a test for residue on evaporation. The adhered gums are included after washing the sample container with gum solvent and residue is washed with heptane also. Results are reported as gm/m$^3$. The maximum allowable limit for gums by this method is 50 gm/m$^3$.

2. Existent Gum test. A measured quantity of fuel (50 ml) is evaporated under controlled temperature and air flow conditions. The resulting residue is weighed and reported as gm/m$^3$. For motor gasoline, the residue is weighed before and after washing with n-heptane and the result reported as gm/m$^3$. The maximum allowable limit for gums by this method is 40 gm/m$^3$.

3. Induction Period test. A measured quantity of fuel (50 ml) is oxidized under prescribed condition in a container Initially filled at 15 to 25 deg. C. with oxygen pressure at 100 psi and heated at a temperature of approximately between 98 to 102 deg. C. the pressure is read at stated intervals or recorded continuously until the break is reached. The time required for the sample to reach this point is observed and reported as the induction period. The maximum allowable limit by this method is 360 minutes.

4. Ambient Aging test. A 400 ml sample of antioxidant doped gasoline is kept in 500 ml capacity borosilicate glass bottles for three months at ambient temperatures in triplicate. After completion of the first, second and third months one set is subjected to the Existent Gum test as per ASTM D-381 and the result reported as gm/m$^3$. Colour of the fuel is also noted after completion of each month.

After initial testing, a candidate composition was additionally tested for following characteristics:

1. Test for Water Reaction Of Fuels. This test is designed to measure the water tolerance characteristics of gasoline. It is a quick way to measure the ability of a fuel to separate rapidly from water after mixing under low shear conditions. Briefly the procedure involves hand shaking of 80 ml of fuel with 20 ml of phosphate buffer solution for two minutes. After a 5 minute settling period, the fuel water interface and water layer are rated for emulsion, the fuel phase and clarity.

2. Dynamic Corrosion test. This test is carried out to evaluate the ability of fuels to prevent rusting of ferrous parts when fuel comes in contact with water. Corrosion can lead to severe problems in storage tanks, pipelines, tankers and automobile fuel tanks. The particles of rust can also clog fuel lines, filters, carburetor orifices or jets. This evaluation procedure is based upon ASTM D-665-95 standard test method for mineral oils with modification so that the test is run at ambient temperature for fuels. 300 ml of the fuel is stirred at 1000±50 rpm with 30 ml of distilled water for 24 hrs. using polished steel spindle conforming to grade 1018 of ASTM A-108 specifications.

Experimental Details—In order to evaluate the performance of the various components, e.g. phenolic antioxidants, amine based antioxidants or Mannich base, a comprehensive evaluation program was undertaken. The evaluation program includes three important variables such as selection of components, optimization of their treat rate and the selection of base gasoline composition. The composition of the base gasoline was kept constant during the evaluation of the selected component. In order to verify the results, a few selected components were also evaluated with different gasoline compositions. The final antioxidant compositions were evaluated in different gasoline compositions being produced by refineries in India. The components were initially evaluated at a low treat rate, and depending on the response, evaluation was continued at higher or lower treat rates. The final composition was up-scaled in a chemical pilot plant and tested on a large scale in one of the Indian refineries. The gasoline composition used for the study are given as follows:

Gasoline Composition-1

| Streams | % Volume |
|---|---|
| FCC Gasoline | 50 |
| Reformate Stream | 40 |
| Vis-breaker Naphtha | 10 |

Gasoline Composition-2

| Streams | % Volume |
|---|---|
| FCC Gasoline | 55 |
| Reformate Stream | 35 |
| K7TOP Stream | 10 |

EXAMPLES 1 to 7

Phenolic antioxidant, 2,6-ditertiary-butyl-para-cresol (DBPC, 99% purity), was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION 1 | 132 |
| 2. | GASOLINE FUEL + 5 mg/lit of DBPC | 66 |
| 3. | GASOLINE FUEL + 10 mg/lit of DBPC | 48 |
| 4. | GASOLINE FUEL + 15 mg/lit of DBPC | 44 |
| 5. | GASOLINE FUEL + 20 mg/lit of DBPC | 40 |
| 6. | GASOLINE FUEL + 30 mg/lit of DBPC | 20 |
| 7. | GASOLINE FUEL + 50 mg/lit of DBPC | 20 |

EXAMPLES 8 to 13

Another liquid hindered phenolic antioxidant, (LHPA), was dissolved in Gasoline Composition 1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of LHPA | 76 |
| 3. | GASOLINE FUEL + 10 mg/lit of LHPA | 64 |
| 4. | GASOLINE FUEL + 15 mg/lit of LHPA | 60 |
| 5. | GASOLINE FUEL + 20 mg/lit of LHPA | 52 |
| 6. | GASOLINE FUEL + 30 mg/lit of LHPA | 42 |
| 7. | GASOLINE FUEL + 50 mg/lit of LHPA | 36 |

EXAMPLES 14 to 17

The above liquid hindered phenolic antioxidant, (LHPA), was dissolved in Gasoline Composition-2 at the ambient temperature. The details of its concentrations in gasoline fuel and the results obtained are given below.

| S. NO | GASOLINE FUEL | POTENTIAL GUM gm/gm$^3$ |
|---|---|---|
| 1. | GASOLINE FUEL AS PER GASOLINE COMPOSITION-2 | 258 |
| 2. | GASOLINE FUEL + 10 mg/lit of LHPA | 158 |
| 3. | GASOLINE FUEL + 20 mg/lit of LHPA | 84 |
| 4. | GASOLINE FUEL + 40 mg/lit of LHPA | 36 |

EXAMPLES 18 to 23

Amine antioxidant, N,N'-Disecondary-butyl-paraphenylenediame (PDA, 99% purity), was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of PDA | 46 |
| 3. | GASOLINE FUEL + 10 mg/lit of PDA | 42 |
| 4. | GASOLINE FUEL + 15 mg/lit of PDA | 40 |
| 5. | GASOLINE FUEL + 20 mg/lit of PDA | 40 |
| 6. | GASOLINE FUEL + 30 mg/lit of PDA | 40 |
| 7. | GASOLINE FUEL + 50 mg/lit of PDA | 38 |

EXAMPLES 24 to 25

The above amine antioxidant, PDA, 99% purity), received from two different sources was dissolved in Gasoline Composition-2 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-2 | 258 |
| 2. | GASOLINE FUEL + 20 mg/lit of PDA-Source A | 28 |
| 3. | GASOLINE FUEL + 20 mg/lit of PDA-Source B | 32 |

Examples 26 to 37

Various Mannich bases were dissolved in Gasoline Composition-1 at the ambient temperature. The details of their concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 20 mg/lit of Mannich Base using CSNL & $C_4$ Amine | 108 |
| 3. | GASOLINE FUEL + 50 mg/lit of Mannich Base using CSNL & $C_4$ Amine | 95 |
| 4. | GASOLINE FUEL + 100 mg/lit of Mannich Base using CSNL & $C_4$ Amine | 80 |
| 5. | GASOLINE FUEL + 150 mg/lit of Mannich Base using CSNL & $C_4$ Amine | 60 |
| 6. | GASOLINE FUEL + 20 mg/lit of Mannich Base using para-nonyl phenol & $C_4$ Amine | 122 |
| 7. | GASOLINE FUEL + 50 mg/lit of Mannich Base using para-nonyl phenol & $C_4$ Amine | 98 |
| 8. | GASOLINE FUEL + 100 mg/lit of Mannich Base using para-nonyl phenol & $C_4$ Amine | 90 |
| 9. | GASOLINE FUEL + 150 mg/lit of Mannich Base using para-nonyl phenol & $C_4$ Amine | 80 |
| 10. | GASOLINE FUEL + 20 mg/lit of Mannich Base using para-dodecyl phenol & $C_4$ Amine | 128 |

-continued

| S. NO | GASOLINE FUEL | POTENTIAL GUM gm/gm$^3$ |
|---|---|---|
| 11. | GASOLINE FUEL + 50 mg/lit of Mannich Base using para-dodecyl phenol & $C_4$ Amine | 118 |
| 12. | GASOLINE FUEL + 100 mg/lit of Mannich Base using CSNL & $C_4$ Amine | 100 |
| 13. | GASOLINE FUEL + 150 mg/lit of Mannich Base using para-dodecyl phenol & $C_4$ Amine | 92 |

EXAMPLES 38 to 43

A combination of phenolic antioxidant, 2,6-ditertiary-butyl-para-cresol (DBPC, 99% purity level) and N,N'-Disecondary-butyl-paraphenylenediame (99% purity in 1:1 weight ratio (AO Combination-1) was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of AO Combination-1 | 42 |
| 3. | GASOLINE FUEL + 10 mg/lit of AO Combination-1 | 42 |
| 4. | GASOLINE FUEL + 15 mg/lit of AO Combination-1 | 40 |
| 5. | GASOLINE FUEL + 20 mg/lit of AO Combination-1 | 40 |
| 6. | GASOLINE FUEL + 30 mg/lit of AO Combination-1 | 28 |
| 7. | GASOLINE FUEL + 50 mg/lit of AO Combination-1 | 28 |

EXAMPLES 44 to 49

Another combination containing liquid hindered phenolic antioxidant (LHPA) and N,N'-Disecondary-butyl-paraphenylenediamine (98% purity) in 1:1 weight ratio (AO Combination-2) was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of AO Combination-2 | 50 |
| 3. | GASOLINE FUEL + 10 mg/lit of AO Combination-2 | 46 |
| 4. | GASOLINE FUEL + 15 mg/lit of AO Combination-2 | 36 |
| 5. | GASOLINE FUEL + 20 mg/lit of AO Combination-2 | 36 |
| 6. | GASOLINE FUEL + 30 mg/lit of AO Combination-2 | 32 |
| 7. | GASOLINE FUEL + 50 mg/lit of AO Combination-2 | 32 |

EXAMPLES 50 to 55

A combination of phenolic antioxidant, 2,6-ditertiary-butyl-para-cresol (DBPC, 99% purity level and Mannich base (prepared by reacting paranonyl phenol, $C_4$-alkyl amine and an aldehyde) in 1:1 weight ration (AO Combination-3) was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of AO Combination-3 | 84 |
| 3. | GASOLINE FUEL + 10 mg/lit of AO Combination-3 | 64 |
| 4. | GASOLINE FUEL + 15 mg/lit of AO Combination-3 | 58 |
| 5. | GASOLINE FUEL + 20 mg/lit of AO Combination-3 | 38 |
| 6. | GASOLINE FUEL + 30 mg/lit of AO Combination-3 | 28 |
| 7. | GASOLINE FUEL + 50 mg/lit of AO Combination-3 | 28 |

EXAMPLES 56 to 61

A combination containing liquid hindered phenolic antioxidant (LHPA) and Mannich base (prepared by reacting paranonyl phenol, $C_4$-alkyl amine and an aldehyde) in 1:1 weight ratio (AO Combination-4) was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of AO Combination-4 | 78 |
| 3. | GASOLINE FUEL + 10 mg/lit of AO Combination-4 | 60 |
| 4. | GASOLINE FUEL + 15 mg/lit of AO Combination-4 | 54 |
| 5. | GASOLINE FUEL + 20 mg/lit of AO Combination-4 | 40 |
| 6. | GASOLINE FUEL + 30 mg/lit of AO Combination-4 | 34 |
| 7. | GASOLINE FUEL + 50 mg/lit of AO Combination-4 | 32 |

EXAMPLES 62 to 66

A combination containing liquid hindered phenolic antioxidant (LHPA) and Mannich base (prepared by reacting paranonyl phenol $C_4$-alkyl amine and an aldehyde) in 1:1 weight ratio (AO Combination-4) was dissolved in Gasoline Composition-2 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-2 | 258 |
| 2. | GASOLINE FUEL + 10 mg/lit of AO Combination-4 | 200 |
| 3. | GASOLINE FUEL + 15 mg/lit of AO Combination-4 | 138 |
| 4. | GASOLINE FUEL + 20 mg/lit of AO Combination-4 | 138 |
| 5. | GASOLINE FUEL + 30 mg/lit of AO Combination-4 | 90 |
| 6. | GASOLINE FUEL + 50 mg/lit of AO Combination-4 | 48 |

EXAMPLES 67 to 72

A combination containing N,N'-Disecondary-butyl-paraphenylenediamine (99% purity) and Mannich base (prepared by reacting paranonyl phenol, $C_4$-alkyl amine and an aldehyde) in 1:1 weight ratio (AO Combination-5) was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of AO Combination-5 | 44 |
| 3. | GASOLINE FUEL + 10 mg/lit of AO Combination-5 | 40 |
| 4. | GASOLINE FUEL + 15 mg/lit of AO Combination-5 | 38 |
| 5. | GASOLINE FUEL + 20 mg/lit of AO Combination-5 | 38 |
| 6. | GASOLINE FUEL + 30 mg/lit of AO Combination-5 | 34 |
| 7. | GASOLINE FUEL + 50 mg/lit of AO Combination-5 | 34 |

EXAMPLES 73 to 78

A combination containing N,N'-Disecondary-butyl-paraphenylenediamine (98% purity) and Mannich base (prepared by reacting paranonyl phenol, $C_4$-alkyl amine and an aldehyde) in 1:2 weight ration (AO Combination-6) was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of AO Combination-6 | 44 |
| 3. | GASOLINE FUEL + 10 mg/lit of AO Combination-6 | 42 |
| 4. | GASOLINE FUEL + 15 mg/lit of AO Combination-6 | 40 |

-continued

| S. NO | GASOLINE FUEL | POTENTIAL GUM gm/gm$^3$ |
|---|---|---|
| 5. | GASOLINE FUEL + 20 mg/lit of AO Combination-6 | 40 |
| 6. | GASOLINE FUEL + 30 mg/lit of AO Combination-6 | 36 |
| 7. | GASOLINE FUEL + 50 mg/lit of AO Combination-6 | 34 |

EXAMPLES 79 to 84

A combination containing N,N'-Disecondary-butyl-paraphenylenediamine (98% purity) and Mannich base (prepared by reacting paranonyl phenol, $C_4$-alkyl amine and an aldehyde) in 1:3 weight ration (AO Combination-7) was dissolved in Gasoline Composition-1 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-1 | 132 |
| 2. | GASOLINE FUEL + 5 mg/lit of AO Combination-7 | 50 |
| 3. | GASOLINE FUEL + 10 mg/lit of AO Combination-7 | 40 |
| 4. | GASOLINE FUEL + 15 mg/lit of AO Combination-7 | 38 |
| 5. | GASOLINE FUEL + 20 mg/lit of AO Combination-7 | 34 |
| 6. | GASOLINE FUEL + 30 mg/lit of AO Combination-7 | 34 |
| 7. | GASOLINE FUEL + 50 mg/lit of AO Combination-7 | 34 |

EXAMPLES 85 to 89

A combination containing N,N'-Disecondary-butyl-paraphenylenediamine (98% purity) and Mannich base (prepared by reacting paranonyl phenol, $C_4$-alkyl amine and an aldehyde) in 1:3 weight ratio (AO Combination-7) was dissolved in Gasoline Composition-2 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-2 | 258 |
| 2. | GASOLINE FUEL + 5 mg/lit of AO Combination-7 | 104 |
| 3. | GASOLINE FUEL + 10 mg/lit of AO Combination-7 | 72 |
| 4. | GASOLINE FUEL + 15 mg/lit of AO Combination-7 | 42 |
| 5. | GASOLINE FUEL + 20 mg/lit of AO Combination-7 | 36 |
| 6. | GASOLINE FUEL + 30 mg/lit of AO Combination-7 | 30 |

EXAMPLES 90 to 94

A combination containing N,N'Disecondary-butyl-paraphenylenediamine (98% purity) and Mannich base (prepared by reacting paranonyl phenol, $C_4$-alkyl amine and an aldehyde) in 1:9 weight ratio (AO Combination-8) was dissolved in Gasoline Composition-2 at the ambient temperature. The details of its concentrations in gasoline fuel and the results obtained are as given below.

| S. NO | GASOLINE FUEL | POTENTIAL GUM gm/gm$^3$ |
|---|---|---|
| 1. | GASOLINE FUEL AS PER GASOLINE COMPOSITION-2 | 258 |
| 2. | GASOLINE FUEL + 5 mg/lit of AO Combination-8 | 118 |
| 3. | GASOLINE FUEL + 10 mg/lit of AO Combination-8 | 72 |
| 4. | GASOLINE FUEL + 15 mg/lit of AO Combination-8 | 44 |
| 5. | GASOLINE FUEL + 20 mg/lit of AO Combination-8 | 40 |
| 6. | GASOLINE FUEL + 30 mg/lit of AO Combination-8 | 36 |

EXAMPLES 95 to 99

A combination containing N,N'-Disecondary-butyl-paraphenylenediamine (98% purity) and Mannich base (prepared by reacting CNSL, $C_4$-alkyl amine and an aldehyde) in 1:3 weight ratio (AO Combination-9) was dissolved in Gasoline Composition-2 at the ambient temperature. The details of its concentrations are as given below.

| S. NO | GASOLINE FUEL | POTENTIAL GUM gm/gm$^3$ |
|---|---|---|
| 1. | GASOLINE FUEL AS PER GASOLINE COMPOSITION-2 | 258 |
| 2. | GASOLINE FUEL + 5 mg/lit of AO Combination-9 | 96 |
| 3. | GASOLINE FUEL + 10 mg/lit of AO Combination-9 | 60 |
| 4. | GASOLINE FUEL + 15 mg/lit of AO Combination-9 | 42 |
| 5. | GASOLINE FUEL + 20 mg/lit of AO Combination-9 | 36 |
| 6. | GASOLINE FUEL + 30 mg/lit of AO Combination-9 | 32 |

In order to establish the efficacy of Antioxidant Combination-7, the same combination was also evaluated in various gasoline fuel compositions with a variety of cracked components and severity. The gasoline samples included in the study were obtained from refineries having Coker/Fluidized Catalytic Cracking (FCC) and the hydrocraker units. It has been observed that the Antioxidant Composition-7 gives the maximum synergism and the composition is able to control potential gum in the gasoline fuel to desirable level.

In order to confirm the potential antioxidant performance of Antioxidant Composition-7, the composition was tested in different gasoline compositions using additional tests such as the Existent Gum test as per ASTM D-381/IP 131, the Induction Period test as per ASTM D-525/IP: 40 and the Ambient Aging test as per IP 378/87 (Modified) for three months. The fuel composition details and results of antioxidant characteristics of Antioxidant Composition-7 are given as follows.

Gasoline Composition-1

| Streams | % Volume |
|---|---|
| FCC Gasoline | 50 |
| Reformate Stream | 40 |
| Vis-breaker Naphtha | 10 |

Gasoline Composition-2

| Streams | % Volume |
|---|---|
| FCC Gasoline | 55 |
| Reformate Stream | 35 |
| K7TOP Stream | 10 |

Gasoline Composition-3

| Streams | % Volume |
|---|---|
| FCC Gasoline | 45 |
| Reformate Stream | 35 |
| Straight Run Naphtha | 10 |
| Vis-breaker Naphtha | 10 |

Gasoline Composition-4

| Streams | % Volume |
|---|---|
| FCC Gasoline | 55 |
| Reformate Stream | 35 |
| Vis-breaker Naphtha | 10 |

Gasoline Composition-5

| Streams | % Volume |
|---|---|
| FCC Gasoline | 40 |
| CRU Stream | 60 |

With Gasoline Composition-1

| S. NO | GASOLINE FUEL | GUM, gm/m$^3$ Potential | Existent | Existent Ambient Aging Test | Induction Time (Min) |
|---|---|---|---|---|---|
| 1 | Base Fuel | 132 | 10 | 55 | 257 |
| 2 | Base Fuel + 5 mg/lit of AO Combination-7 | 50 | 10 | 38 | 400 |
| 3 | Base Fuel + 10 mg/lit of AO Combination-7 | 40 | 10 | 38 | 435 |

With Gasoline Composition-2

| S. NO | GASOLINE FUEL | GUM, gm/m³ Poten-tial | Existent | Existent Ambient Aging Test | Induction Time (Min) |
|---|---|---|---|---|---|
| 1 | Base Fuel | 258 | 16 | 76 | 207 |
| 2 | Base Fuel + 15 mg/lit of AO Combination-7 | 42 | 16 | 38 | 420 |
| 3 | Base Fuel + 20 mg/lit of AO Combination-7 | 36 | 16 | 38 | 540 |

With Gasoline Composition-3

| S. NO | GASOLINE FUEL | GUM, gm/m³ Poten-tial | Exis-tent | Existent Ambient Aging Test | Induction Time (Min) |
|---|---|---|---|---|---|
| 1 | Base Fuel | 118 | 8 | 52 | 300 |
| 2 | Base Fuel + 5 mg/lit of AO Combination-7 | 40 | 8 | 34 | 430 |
| 3 | Base Fuel + 10 mg/lit of AO Combination-7 | 38 | 8 | 32 | 540 |

With Gasoline Composition-4

| S. NO | GASOLINE FUEL | GUM, gm/m³ Poten-tial | Exis-tent | Existent Ambient Aging Test | Induction Time (Min) |
|---|---|---|---|---|---|
| 1 | Base Fuel | 289 | 14 | 70 | 189 |
| 2 | Base Fuel + 5 mg/lit of AO Combination-7 | 42 | 14 | 36 | 430 |
| 3 | Base Fuel + 10 mg/lit of AO Combination-7 | 40 | 14 | 34 | 510 |

With Gasoline Composition-5

| S. NO | GASOLINE FUEL | GUM, gm/m³ Poten-tial | Exis-tent | Existent Ambient Aging Test | Induction Time (Min) |
|---|---|---|---|---|---|
| 1 | Base Fuel | 232 | 12 | 72 | 200 |
| 2 | Base Fuel + 5 mg/lit of AO Combination-7 | 40 | 12 | 38 | 410 |
| 3 | Base Fuel + 10 mg/lit of AO Combination-7 | 36 | 12 | 34 | 540 |

Water Reaction of Fuels

Gasoline with Antioxidant Composition-7 was evaluated and the results are given as follows:

| Sr. No. | Product | Test Results |
|---|---|---|
| 1 | GASOLINE COMPOSITION-1 + 20 mg/lit of AO Combination-7 | Pass |
| 2 | GASOLINE COMPOSITION-2 + 20 mg/lit of AO Combination-7 | Pass |
| 3 | GASOLINE COMPOSITION-3 + 20 mg/lit of AO Combination-7 | Pass |
| 4 | GASOLINE COMPOSITION-4 + 20 mg/lit of AO Combination-7 | Pass |
| 5 | GASOLINE COMPOSITION-5 + 20 mg/lit of AO Combination-7 | Pass |

Addition of AL Combination-7 does not deteriorate the gasoline quality.

Dynamic Corrosion Test

The test results are as follows:

| Sr. No. | Product | Test Results |
|---|---|---|
| 1 | GASOLINE COMPOSITION-1 + 20 mg/lit of AO Combination-7 | Pass |
| 2 | GASOLINE COMPOSITION-2 + 20 mg/lit of AO Combination-7 | Pass |
| 3 | GASOLINE COMPOSITION-3 + 20 mg/lit of AO Combination-7 | Pass |
| 4 | GASOLINE COMPOSITION-4 + 20 mg/lit of AO Combination-7 | Pass |
| 5 | GASOLINE COMPOSITION-5 + 20 mg/lit of AO Combination-7 | Pass |

The gasoline quality is not deteriorated on addition of AO Combination-7 in terms of corrosion.

Large Scale Trial of Antioxidant Composition-7

The Antioxidant Composition-7 was tested at large scale in one of the Indian Oil Refineries. Antioxidant Composition-7 was prepared in bulk and transported to the refinery in HDPE drums. Initially, the composition was tested in the refinery laboratory. A laboratory blend of gasoline containing an FCC stream was prepared in consultation with the technical department with the refinery. The composition of gasoline used for evaluation work was as follows.

| Streams | % Volume |
|---|---|
| FCC Gasoline of Refinery-A | 55 |
| Reformate Stream of Refinery-A | 35 |
| K7TOP Stream of Refinery-A | 10 |

The Antioxidant Composition-7 along with the Commercial Antioxidant (N,N'-Disecondary-butyl-paraphenylenediamine) already in use at the refinery were tested for Potential Gum as per ASTM D-873/IP: 138 (Modified). The laboratory evaluation data revealed that Antioxidant Composition-7 is quite effective even at 10 mg/lit treat level compared to the Commercial Antioxidant (N,N'-Disecondary-butyl-paraphenylenediamine). Results are summarised as follows.

| Antioxidant | Treat Rate, mg/lit | Potential Gum, g/m$^3$ |
|---|---|---|
| — | — | 158 |
| Commercial Amine AO | 10 | 44 |
| Commercial Amine AO | 20 | 38 |
| Antioxidant Composition-7 | 10 | 26 |
| Antioxidant Composition-7 | 20 | 20 |

As a sequel to laboratory testing, the Antioxidant Composition-7 was added in two tanks (about 7300KL) at a treat rate of 10 mg/lit, which is 50% lower than the regular treat rate of commercial AO being used at the test refinery. Results are summarised as follows.

| Tank No. | Potential Gum, g/m$^3$ |
|---|---|
| Intermediate Sample From Gasoline Tank No. 61 | 22 |
| Final Sample From Gasoline Tank 61 | 20 |
| Intermediate Sample From Gasoline Tank 76 | 18 |
| Final Sample From Gasoline Tank 76 | 20 |

Further, the detailed costing of the Antioxidant Composition-7 indicates that it is quite cheap compared to the commercial AO.

We claim:

1. An antioxidant composition containing, in a weight ratio of 1:3, at least one amine comprising N,N'-disecondary-butyl-paraphenylenediamine and at least one Mannich base obtained from the reaction of paranonyl phenol, $C_4$-alkyl amine, and an aldehyde, said composition being effective in a predetermined amount for stabilizing gasoline and gasoline components.

2. A method of stabilizing gasoline and gasoline components, the method comprising adding to the gasoline or gasoline component an effective amount of an antioxidant composition containing, in a weight ratio of 1:3, at least one amine comprising N,N'-disecondary-butyl-paraphenylenediamine and at least one Mannich base obtained from the reaction of paranonyl phenol, $C_4$-alkyl amine, and an aldehyde, in an amount effective at stabilizing gasoline and gasoline components.

3. The method of claim 2, wherein the effective amount is from approximately 5 to 50 mg of the antioxidant composition per liter of gasoline.

* * * * *